US006599002B2

(12) United States Patent
Hsieh et al.

(10) Patent No.: US 6,599,002 B2
(45) Date of Patent: Jul. 29, 2003

(54) LED SIGNAL LIGHT

(75) Inventors: Chih-Tang Hsieh, Taipei (TW); Po-Laung Huang, Taipei (TW); Chan-Ching Lin, Taipei (TW)

(73) Assignee: Ahead Optoelectronics, Inc., Taipei (TW)

( * ) Notice: Subject to any disclaimer, the term of this patent is extended or adjusted under 35 U.S.C. 154(b) by 0 days.

(21) Appl. No.: 09/835,368

(22) Filed: Apr. 17, 2001

(65) Prior Publication Data

US 2002/0149949 A1 Oct. 17, 2002

(51) Int. Cl.[7] ..... F21V 7/04

(52) U.S. Cl. ..... 362/555; 362/240; 362/244; 362/326; 362/335; 362/336; 362/337; 362/800

(58) Field of Search ..... 362/244, 800, 362/240, 326, 335, 336, 337, 555

(56) References Cited

U.S. PATENT DOCUMENTS 4,729,076 A * 3/1988 Masami et al. ..... 362/235
5,174,649 A 12/1992 Alston
5,343,330 A 8/1994 Hoffman et al.
5,833,355 A 11/1998 You et al.
6,257,742 B1 * 7/2001 Sjoberg ..... 362/336

* cited by examiner

*Primary Examiner*—Sandra O'Shea
*Assistant Examiner*—Jacob Y. Choi

(57) ABSTRACT

An LED (light-emitting diode) signal light comprises a light source composed of a plurality of LEDs mounted on a circuit board and light is cast from a front mantle capable of modulating optically, wherein an external lateral surface of the front mantle is a smooth plane while an internal lateral surface is provided with a plurality of lens cells, which are located oppositely against the LEDs correspondingly. Both the architecture of the cutaway and the cross sections of the lens cell implicate an arcuate curve with an opening oriented a smooth plane. Light cast from an LED will undergo optical modulation of the plurality of lens humps on the lens cell so as to redistribute the light in vertical and horizontal direction and adjust orientation of light to the specified illumination areas.

14 Claims, 16 Drawing Sheets

LED SIGNAL LIGHT

FIELD OF THE INVENTION

This invention relates generally to signal lights, more particularly, it relates to an LED (light-emitting diode) signal light wearing an optical modulating front mantle, wherein light emanated from an LED is modulated by a plurality of continuously arrayed lens humps of a correspondent opposite lens cell so that the vertical and horizontal components of light are redistributed and cast on specified areas for full application of the LED light.

BACKGROUND OF THE INVENTION

Most of the conventional lighting fixtures, such as traffic lights, signal lights, etc. are using incandescent bulbs as its light source, which, however, is found particularly defective: in power consumption and lifetime that need frequent replacements from time to time; in its reflective convergent plate that may flash back sunshine to dazzle a driver; and in light-emanating manner that wastes upwardly diverged light energy.

Compared with the incandescent bulb, a mono-color LED (light-emitting diode) lamp would consume lesser power, create littler heat, and enjoy longevity. When an LED light source is applied for traffic light, signal light, etc., it can reportedly save electric energy for 80% up and reduce maintenance charge and replacement frequency accordingly, and moreover, avoid the sunshine reflection phenomenon that may put a driver under dangerous situation.

However, in consideration of the relatively narrower emission angle, the weaker radiant power (illumination intensity), and the shorter transmission valid range of the LED light source, optical modulation becomes necessary when it is applied for longer-distance illumination. By optical modulation, the orientation of the LED's light can be adjusted and distributed again to project and concentrate most of its energy on a specified area with least quantity of LED in conformity with examination standards of signal lights and/or illumination equipment, such as the standards of traffic light of the Institute of Transportation Engineers (ITE).

In an embodiment of a conventional U.S. Pat. No. 5,174,649 shown in FIGS. 1A and 1B—"LED Lamp including Reactive Lens Element"—a plurality of concave-convex lenses 901 is arranged on a light-incident surface 900 of a lamp shade 90 for adjusting the light emanated from a LED light source 904 to become parallel beams 905 incident upon the light-incident surface 900. Then, the parallel beams 905 leave the light-incident surface 900 behind and go forward through an external surface 902, and a plurality of arcuate protruding fillets. 903 attached vertically on the external surface 902 for being converged. In this case, some defects are found as the following though light is optically modulated:

(1) The part of light beams above vision level of the pedestrian or the driver is wasted.

(2) The arcuate protruding fillets 903 are liable to be contaminated to lower down its due functions.

In an embodiment of another conventional U.S. Pat. No. 5,343,330 shown in FIG. 2—Double Refraction and Total Reflection Solid Non-imaging Lens—a storage cell 910 containing an LED light source is concavely disposed behind a plurality of lenses 91, wherein the LED light is refracted by a refraction layer 911 or total-reflected by a reflection surface 912, then passes through an emission surface 913 in parallel or in converged beams. In this case, some defects are found and described below though optical modulation is applied:

(1) The part of light beams above vision level of the pedestrian or the driver is wasted.

(2) As every piece of LED must be plugged and soldered in each storage cell, 910, it's rather difficult for assembling a number of LEDs and lenses in such a manner as of the printed circuit board (PCB).

In an embodiment of yet another conventional U.S. Pat. No. 5,833,355 shown in FIGS. 3A, 3B—LED illuminated lamp assembly—a plurality of flat mirror bands 92 laid horizontally is arranged on the bottom face of a lampshade and divided into an upper and a lower half portion 920, 923 for modulation of a correspondent row of LED light source. The upper half portion 920 further comprises a plain surface 921 and a curved surface 922 for refracting light downwards, and the lower half portion 923 further comprises an upper section 924 having a plain or curved surface and a lower section 925 having a plurality of arcuate protruding fillets, wherein the upper section 924 is provided for penetration of light while the arcuate protruding fillets of the lower section 925 for modulation of horizontal light. In this case, however, light is modulated in marching direction and the portion of light above horizontal level is eliminated, there are still some defects found as the following:

(1) The flat mirror bands are liable to form light in bands that will worsen the distribution of light.

(2) The upper half portion of the mirror bands cannot be horizontally modulated so that image aberration with respect to the lower half portion is created to affect vision effect.

For improvements, optical modulation is availed upon for the LED signal light of this invention so as to eliminate above defects. The LED signal light comprises a plurality of LEDs serving for a light source mounted on a circuit board, and light is cast through a front mantle capable of optical modulation. An external lateral surface of the front mantle is a smooth plane (light-casting surface), while an internal lateral surface (light-incident surface) is provided with a plurality of lens cells located correspondingly and oppositely to the LEDs, which, the lens cells, can perform optical modulation. A plurality of lens humps is formed on surface of the lens cell opposite against the LEDs, wherein the lens humps are arrayed continuously in vertical and horizontal direction with equal or unequal curvatures; both the architecture of the cutaway and the cross sections of the lens cell implicate an arcuate curve with an opening oriented a smooth plane. After directional modulation made by the plurality of lens humps of the lens cell, the light come from the LED light source is readjusted and redistributed to cast on some specified areas, so that an efficient application of the LED light source is made possible.

SUMMARY OF THE INVENTION

The primary object of this invention is to provide an LED signal light, in which a plurality of lens cells is disposed on a light-incident surface of a front mantle, so that the vertical component of light is modulated to cast at some specified areas and the horizontal component of light is redistributed by means of light modulation of the lens cells.

Another object of this invention is to provide an LED signal light, in which a plurality of lens humps with equal or unequal curvature is intensively arrayed on a light-incident surface of a lens cell, such that the light emanated from a light source is modulated into a plurality of lighting points for redistributing the outcast light uniformly.

A yet another object of this invention is to provide an LED signal light, in which a plurality of lens cells may be reorganized to form a front mantle in any shape or configuration desired on the basis of a unit lens cell.

A further object of this invention is to provide an LED signal light, in which the light-cast surface of a front mantle is a dust-proof smooth plane.

For more detailed information regarding advantages or features of this invention, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE INVENTION

Figure 1A:
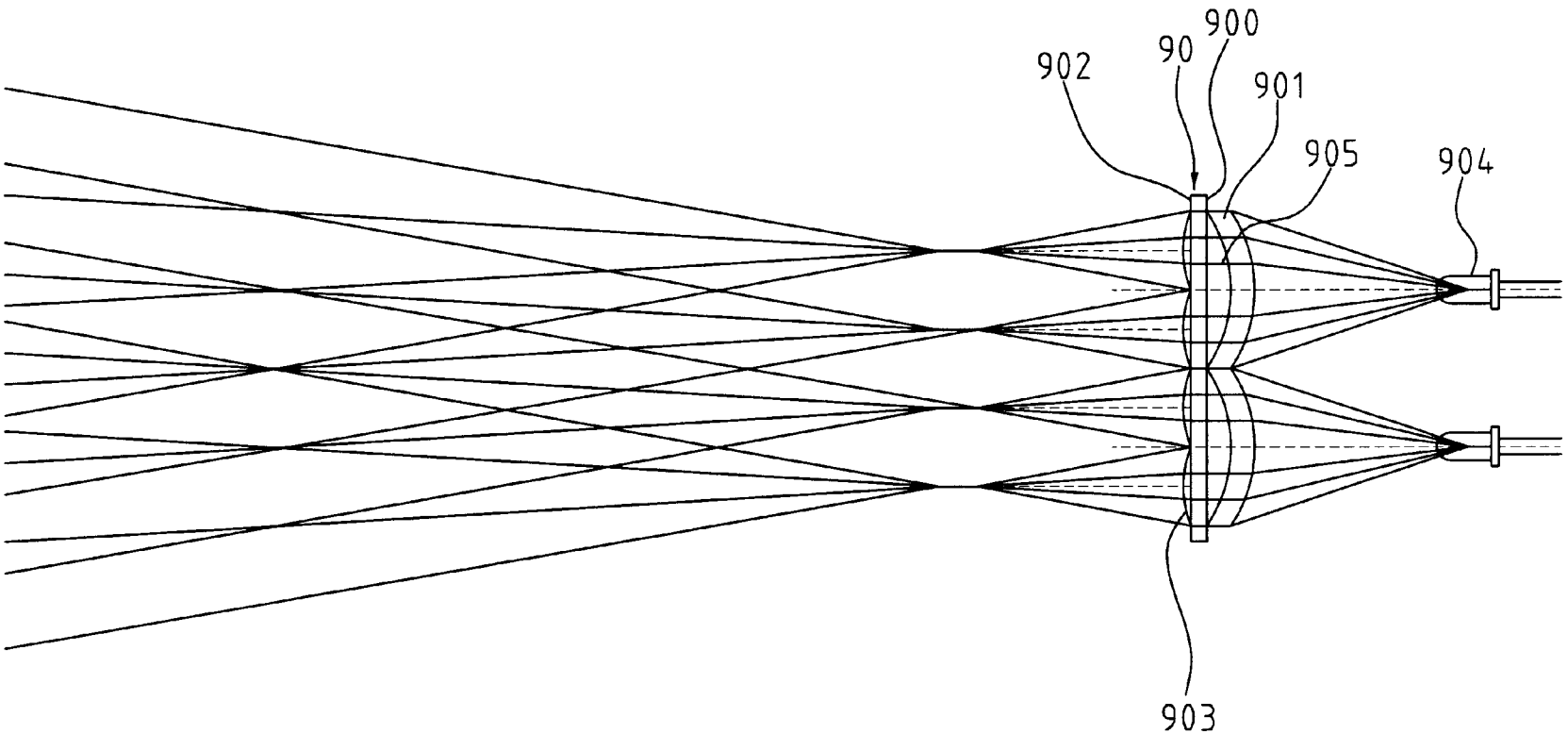
FIG. 1A (PRIOR ART)
FIG. 1A is a top view showing the light-casting path of a U.S. Pat. No. 5,174,649.

As shown in FIGS. 4 through 6, 6A, and 6B, an LED (light-emitting diode) signal light of this invention comprises a plurality of LED light sources (20) assembled on a circuit board (2) and a front mantle (1) for light-modulation.

An external lateral surface of the front mantle (1) is a smooth plane (the surface where light escapes from), which is a plain surface, a convex surface, or an arcuate concave surface, while it is a plain surface in this case. An internal lateral surface of the front mantle (1) (light-incident surface) is provided with a plurality of lens cells (11), which can be arrayed in an intensive, a staggered, or a blended manner to match with the shape of the front mantle (1), which is substantially a circle in this embodiment.

Figure 6A:
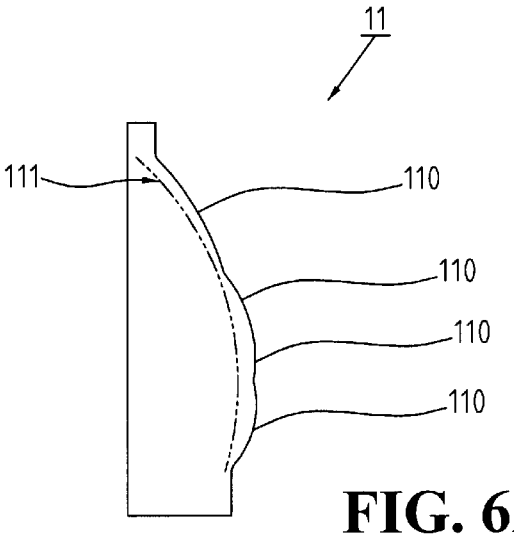
FIG. 6A is a cutaway sectional view of the lens cell of this invention.
Figure 6B:
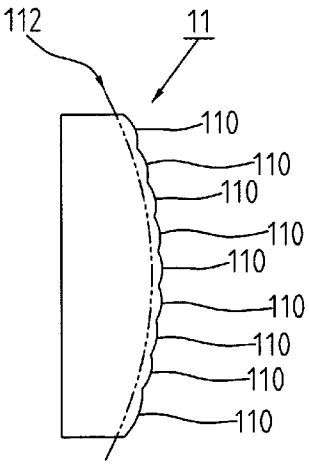
FIG. 6B is a cross-sectional view of the lens cell of this invention.
Figure 6:
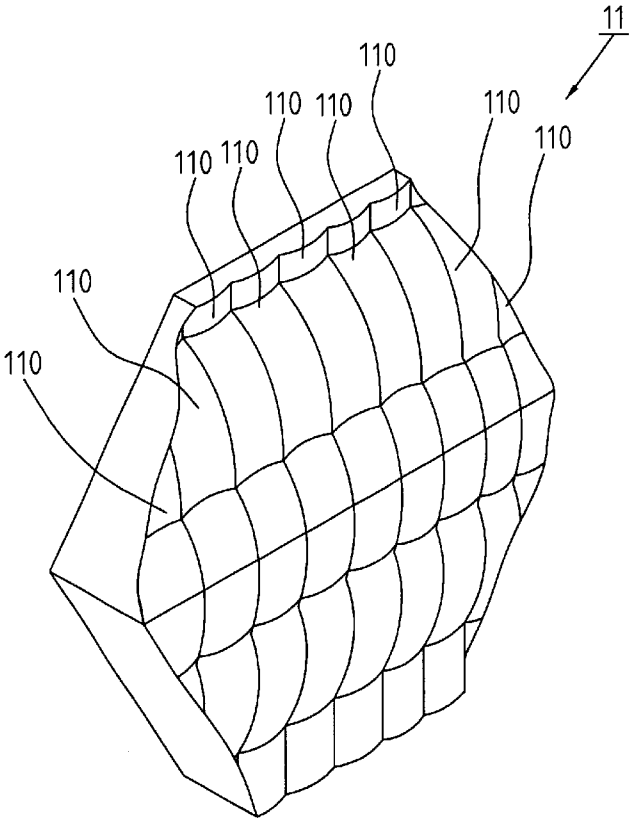
FIG. 6 is a schematic view in three dimensions showing the lens cell of this invention.

The lens cell (11) is basically a lens shaped in a polygon or an approximate circle when viewed from the front end, and it's a hexagonal lens used for light-modulation in this embodiment, wherein the lens cells (11) are disposed correspondingly and oppositely to the respective LED light sources (20). As indicated in FIGS. 6A and 6B, an opening of a cutaway vertical section and a cross horizontal section of the lens cell (11) respectively are considered individual arcuate curves (111, 112) pointing to the smooth plane, wherein the opening of the vertical arcuate curve (111) is oriented obliquely downwards while the opening of the horizontal arcuate curve (112) is symmetrical bilaterally. The convex surface of the lens cell (11) opposite to the LED (20) is provided with a plurality of consecutive lens humps (110) with different radii arrayed intensively in both the vertical and horizontal directions to form a lens cell (11) filled with lens humps (110) intensively for optical modulation, wherein the radius of each lens hump (110) in vertical and in horizontal directions are different from each other.

Figure 7:
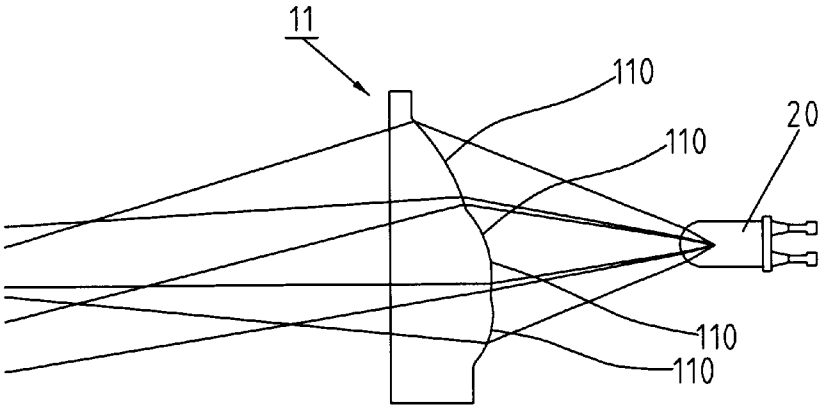
FIG. 7 is a schematic view showing the cutaway section and light-casting path of this invention.
Figure 7A:
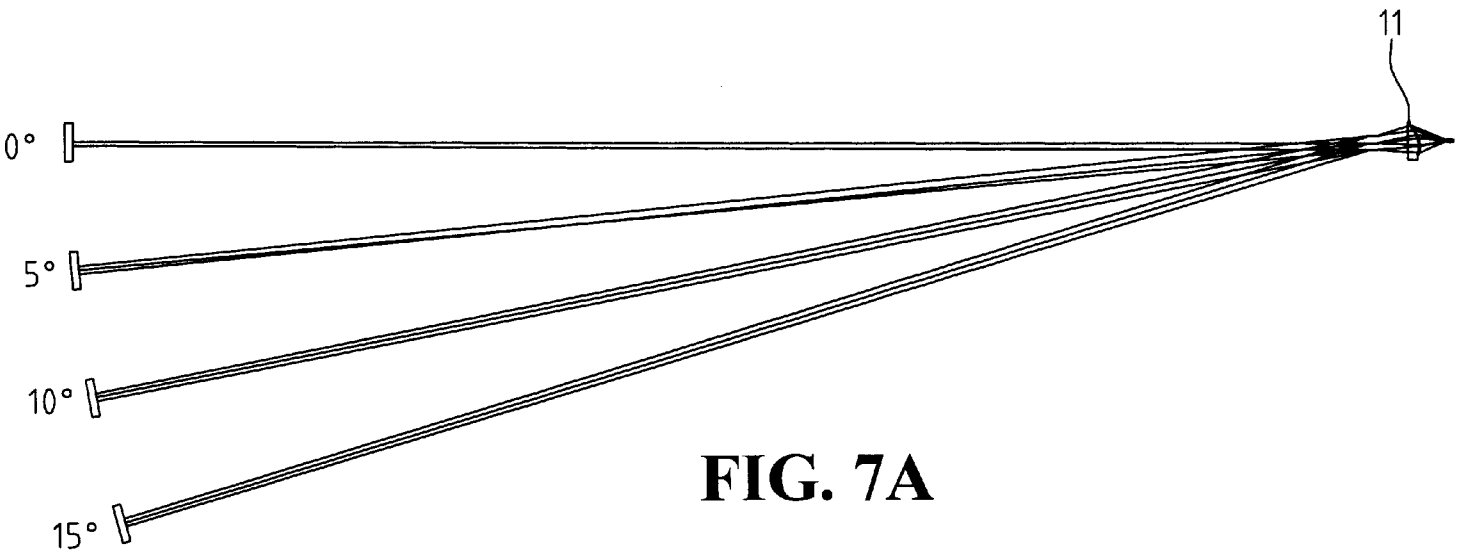
FIG. 7A shows a plurality of far-distance observation positions from the lens cell.

Referring to FIGS. 7 and 7A, rays of the LED light source (20) perpendicular to the lens cell (11) penetrate through the lens humps (110) for modulation and focus at somewhere in front of the lens cell (11). In FIG. 7A, several predetermined positions about one meter far from the lens cell (11) are equally spaced by 5° where an observer can stand from point to point stepwise to observe the virtual image of the LED light source in every lens cell (11) as shown in FIGS. 9 and 9A through 9C. As the opening of the vertical arcuate curve (111) is oriented obliquely downwards such that the part of upwardly convergent light (angle of elevation>0°) from the LED light source (20) is modulated and bent to point downwards below the horizontal level and distributed again to expected directions and areas.

Figure 8:
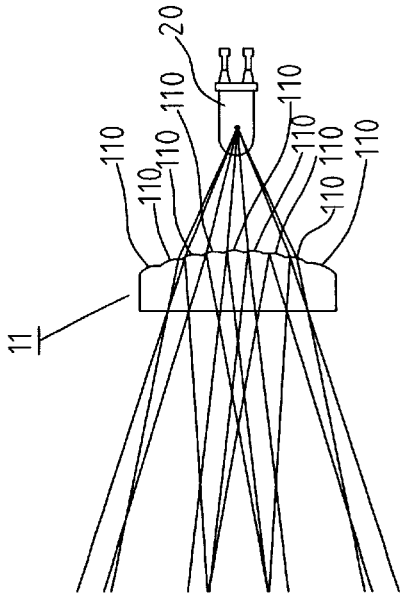
FIG. 8 shows the cross section and light-casting path of this invention.
Figure 8A:
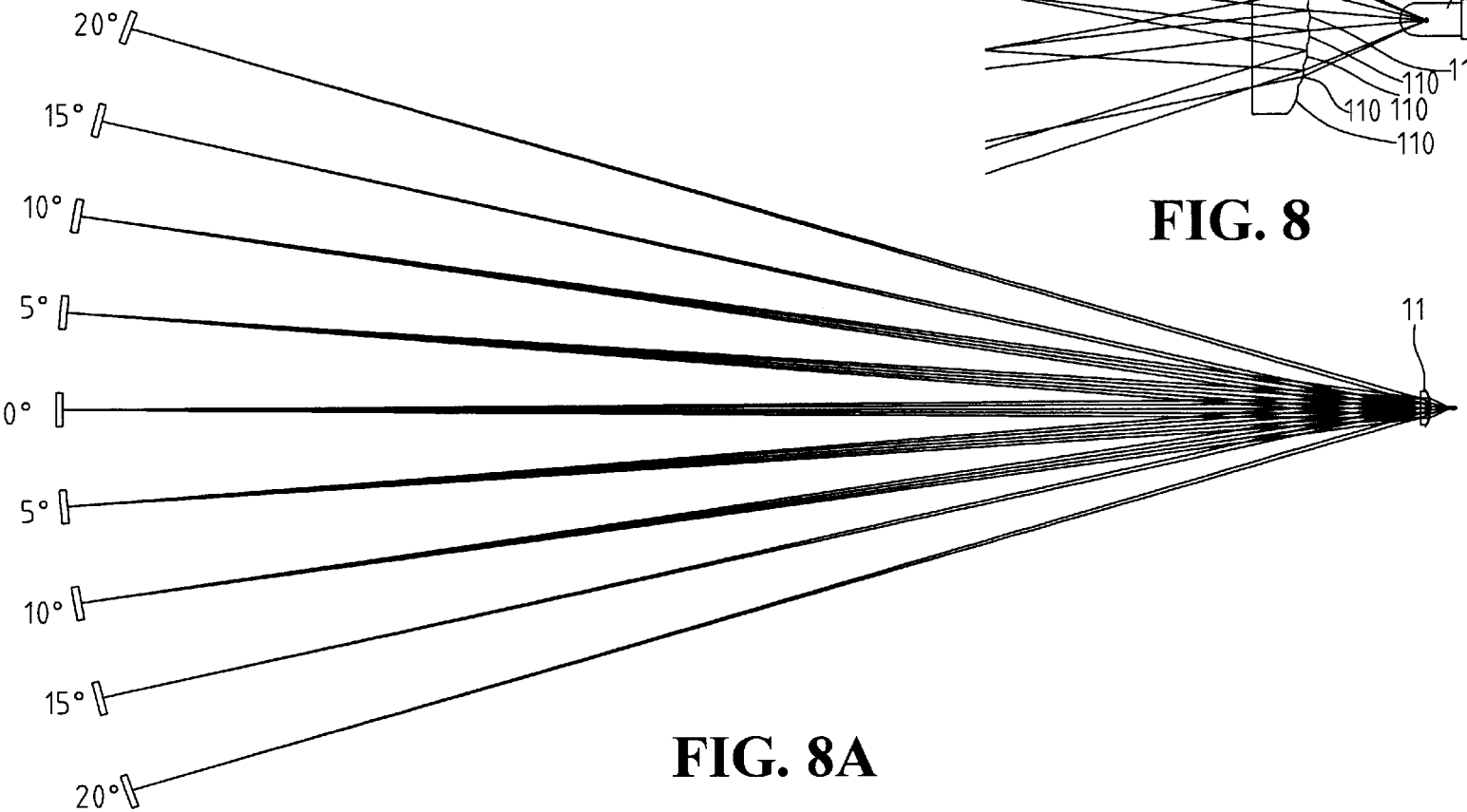
FIG. 8A shows a plurality of far-distance observation positions symmetrical up and down from the lens cell.

The light emanated from the LED light source (20) shown in FIGS. 8 and 8A undergoes modulation of the lens hump (110) then is focused at somewhere in front of the lens cell (11) and reassigned to cast at some horizontal positions or areas. In FIG. 8A, the spaced positions and areas are located about one meter far from the lens cell (11) where an observer can stand from point to point stepwise to observe the virtual image of the LED light source in every lens cell (11) as shown in FIGS. 9 and 9A through 9C. The opening of the horizontal arcuate curve (112) is symmetrical bilaterally and capable of modulating the horizontal component of the LED light source (20) so as to reassign the light bundles to cast at some specified areas.

Figure 9:
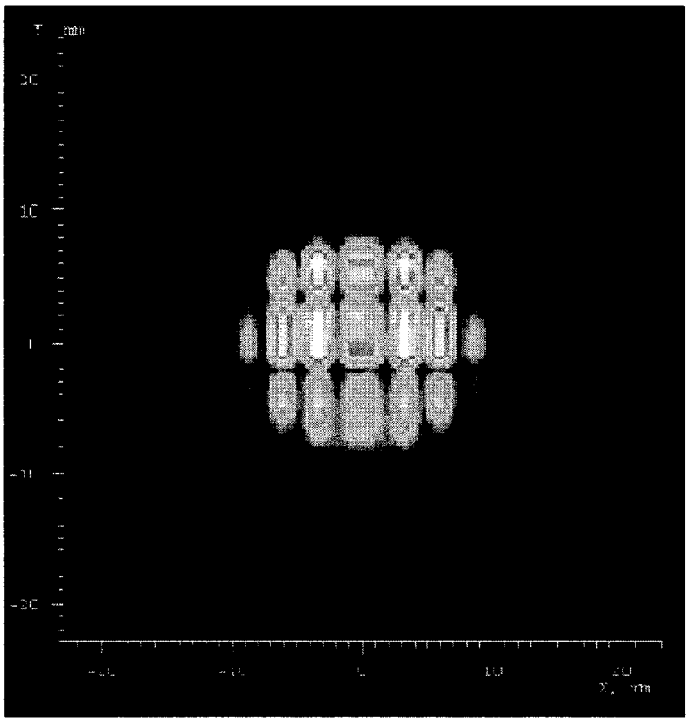
FIG. 9 is a plotted diagram showing luminance intensities in front of the lens cell.
Figure 9A:
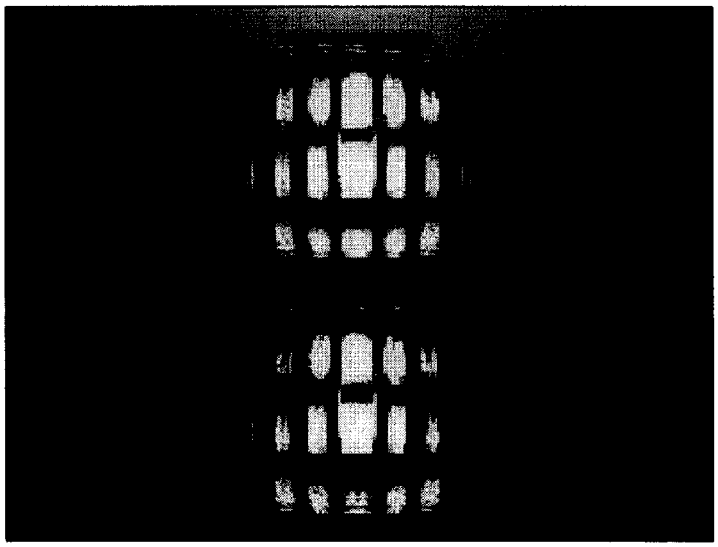
FIG. 9A shows an image 1 when the lens cell is observed at a front position on the horizontal level.
Figure 9B:
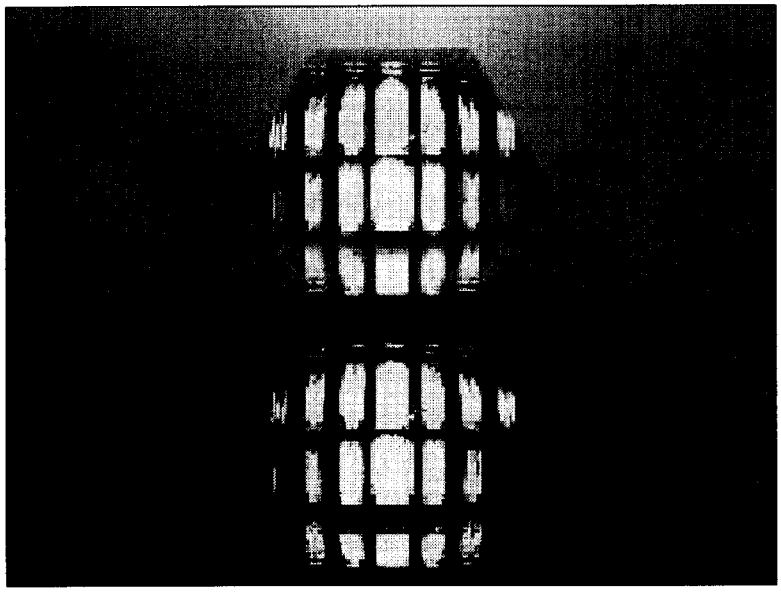
FIG. 9B shows an image 2 when the lens cell is observed at a front position 30 inclined below the horizontal level.
Figure 9C:
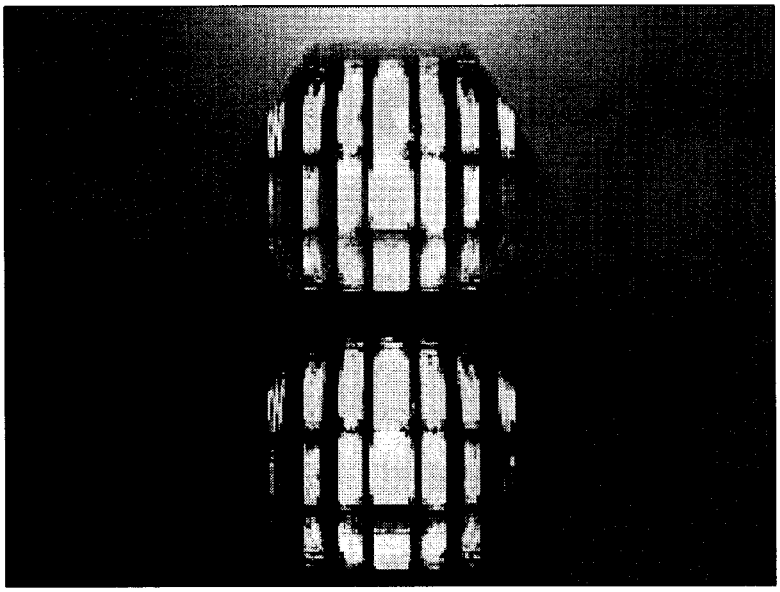
FIG. 9C shows an image 3 when the lens cell is observed at a front position 5° inclined below the horizontal level.

From FIG. 9—the diagram of a first embodiment of this invention showing luminance intensity in front of the lens cell (11)—it is understood the way a single LED light source (20) is modulated by the lens cell (11) and redistributed to become a plurality of illumination sections, or more precisely speaking, light is cast on the intensively arrayed lens humps (110) of the lens cell (11) and expanded into a good many small light emitters that could form an approximate plane light source to efficiently play a traffic signal light. In FIGS. 9A through 9C, a virtual image is viewed from different points in different angles about one meter far in front of an LED light source, wherein an observer stands at the horizontal position in FIG. 9A, at a position 3° inclined below the horizontal level in FIG. 9B, and 5° inclined below in FIG. 9C. Thanks to the lens humps (110) in different radii arranged on each lens cell (11), an LED point light-source could be modulated to become a plane light source with better efficiency.

Figure 10:
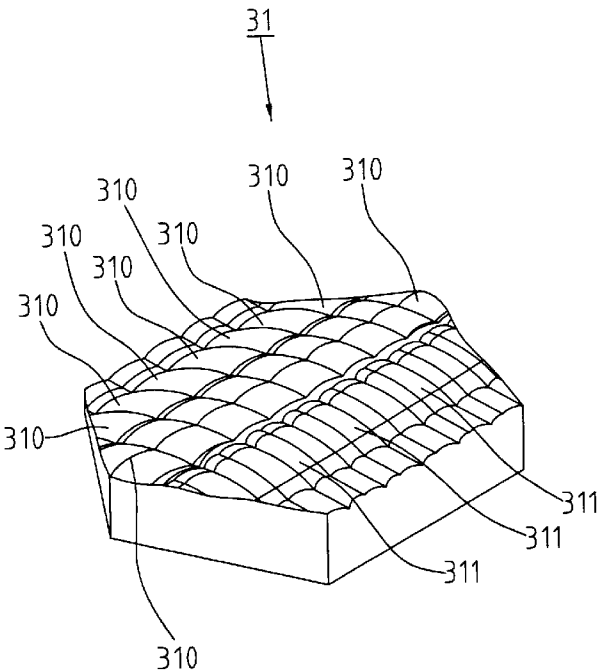
FIG. 10 is a perspective view of an embodiment 2 of the lens cell of this invention.

In a second embodiment of this invention shown in FIG. 10, a lens cell (31) is divided into an upper and a lower segment, which are further provided with continuous lens humps (310, 311) in different respective widths so as to form lens hump groups (310, 311) in different densities. The lens hump (310) at an upper half segment of the lens cell (31) has a larger width and lower density while the lens hump (311) has a smaller width and higher density. Besides, the lens humps (311) are aligned linearly, and an arcuate curve in horizontal direction at the lower half segment of the lens cell (31) can be extended laterally without limit and applied in LED signal light system.

Figure 1B:
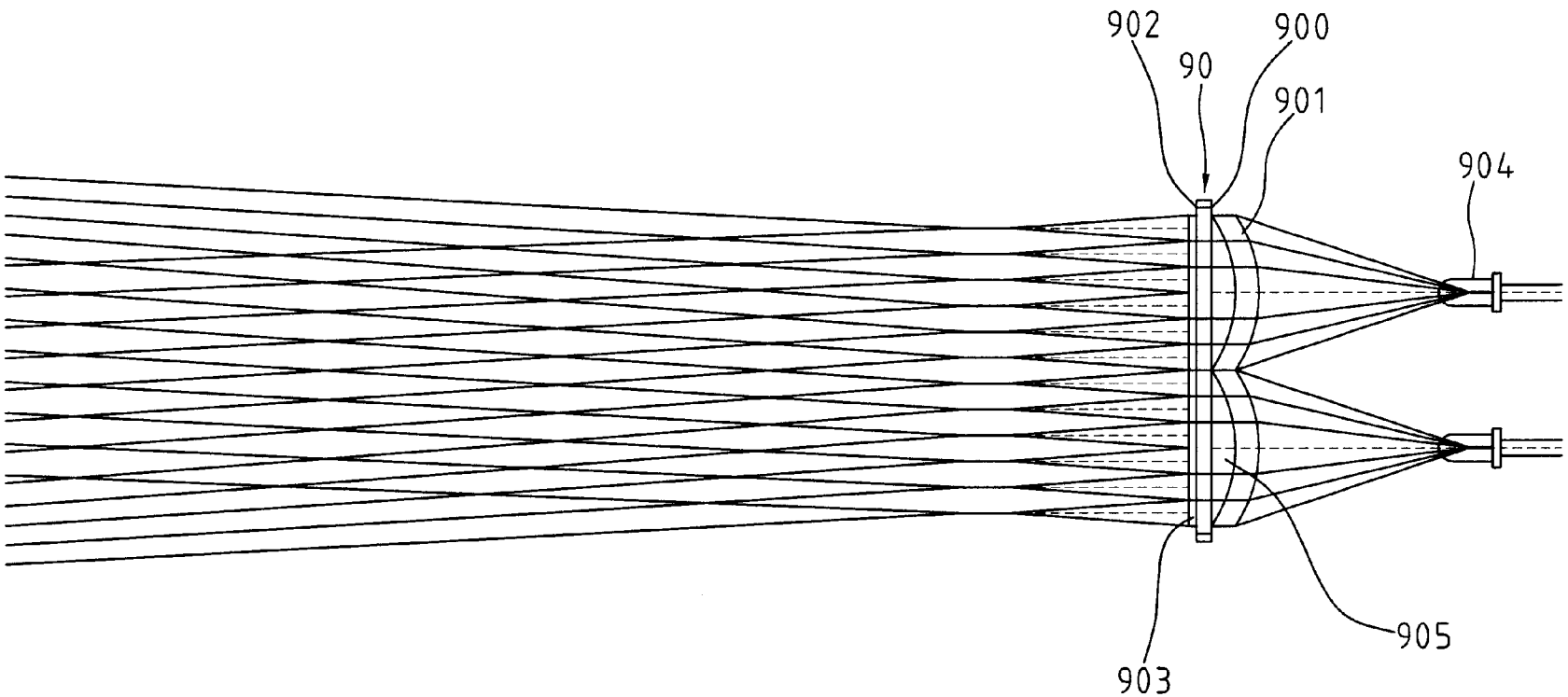
FIG. 1B (PRIOR ART)
FIG. 1B is a lateral view showing the light-casting path of the U.S. Pat. No. 5,174,649.
Figure 2:
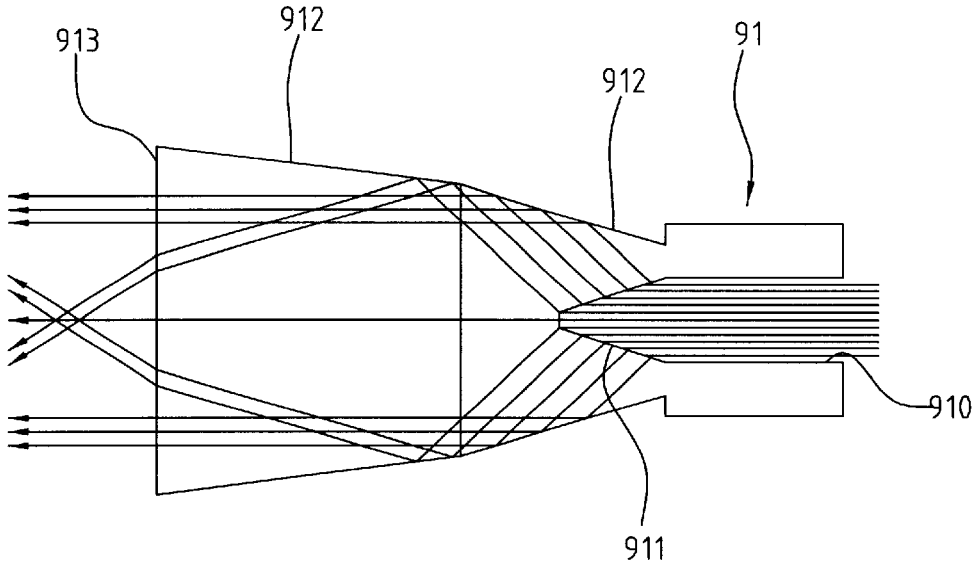
FIG. 2 (PRIOR ART)
FIG. 2 is a lateral view showing a cutaway section and the light-casting path of another U.S. Pat. No. 5,343,330.
Figure 3A:
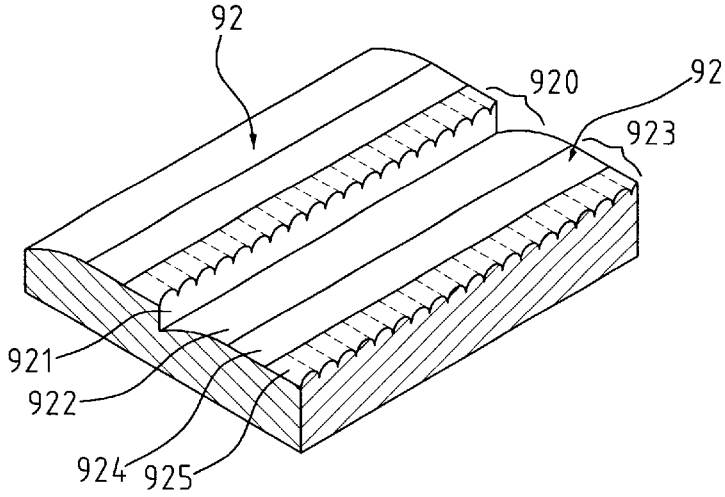
FIG. 3A (PRIOR ART)
FIG. 3A is a partial perspective view of a flat mirror band in a yet another U.S. Pat. No. 5,833,355.
Figure 3B:
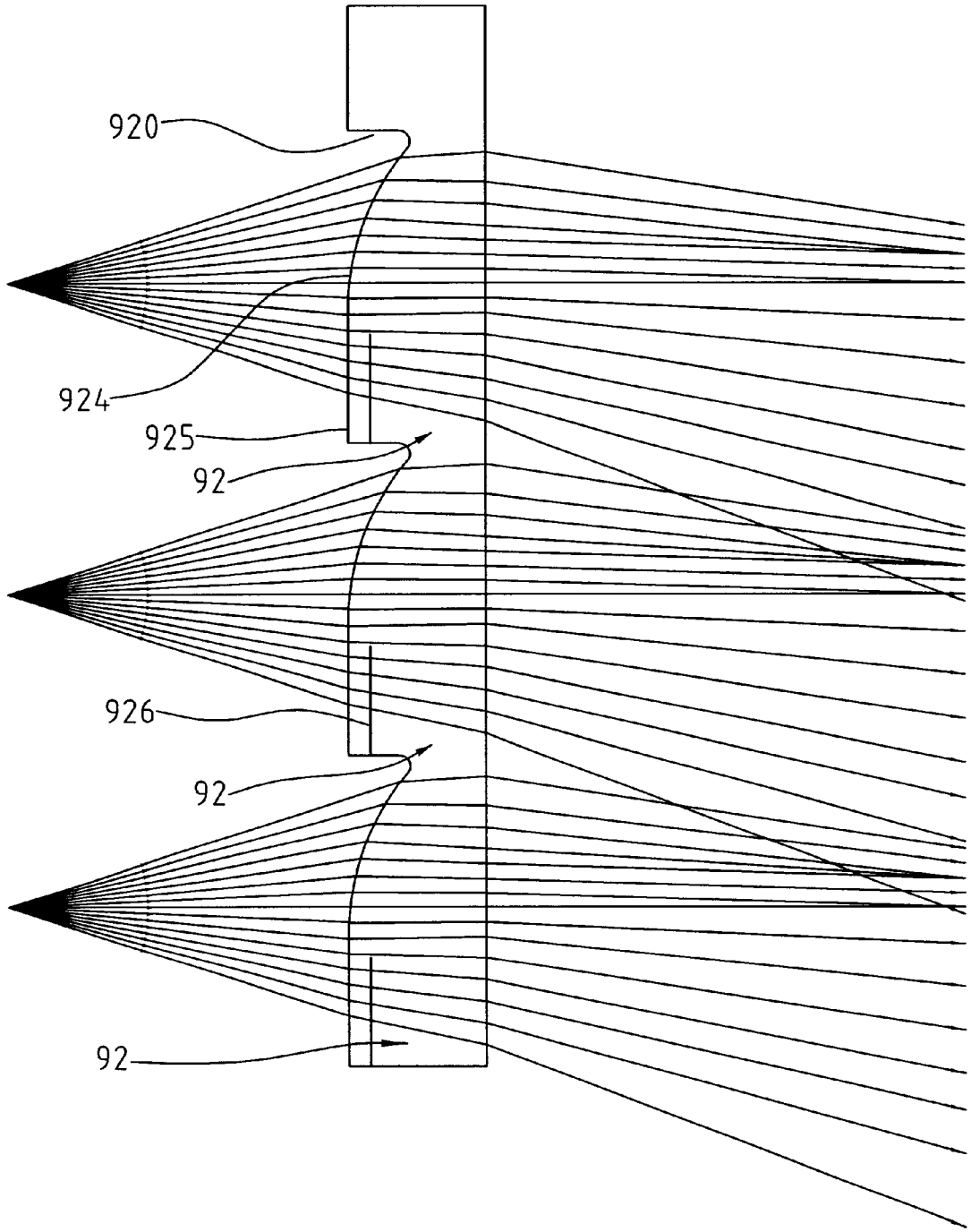
FIG. 3B (PRIOR ART)
FIG. 3B is a lateral view showing the light-casting path of the U.S. Pat. No. 5,833,355.
Figure 4:
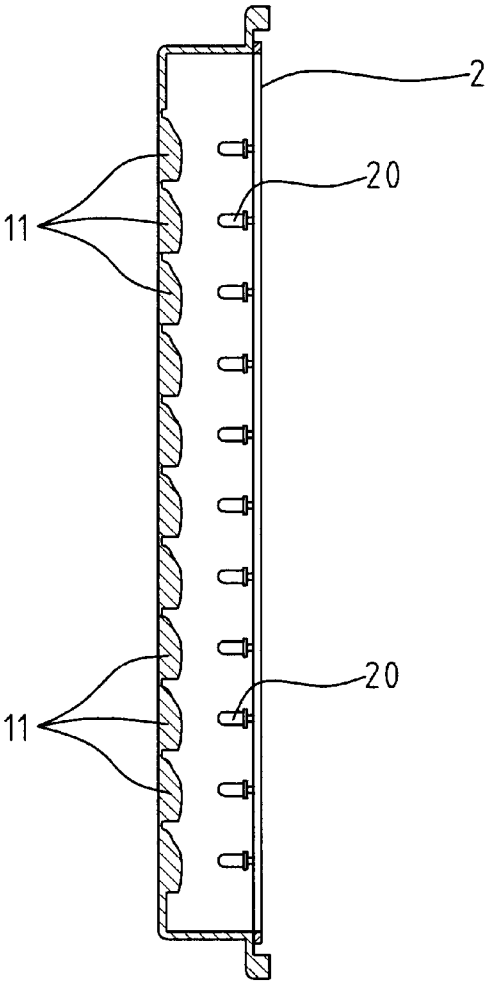
FIG. 4 is a cutaway sectional view of an embodiment of this invention showing that lens cells are standing oppositely against correspondent LEDs.
Figure 5:
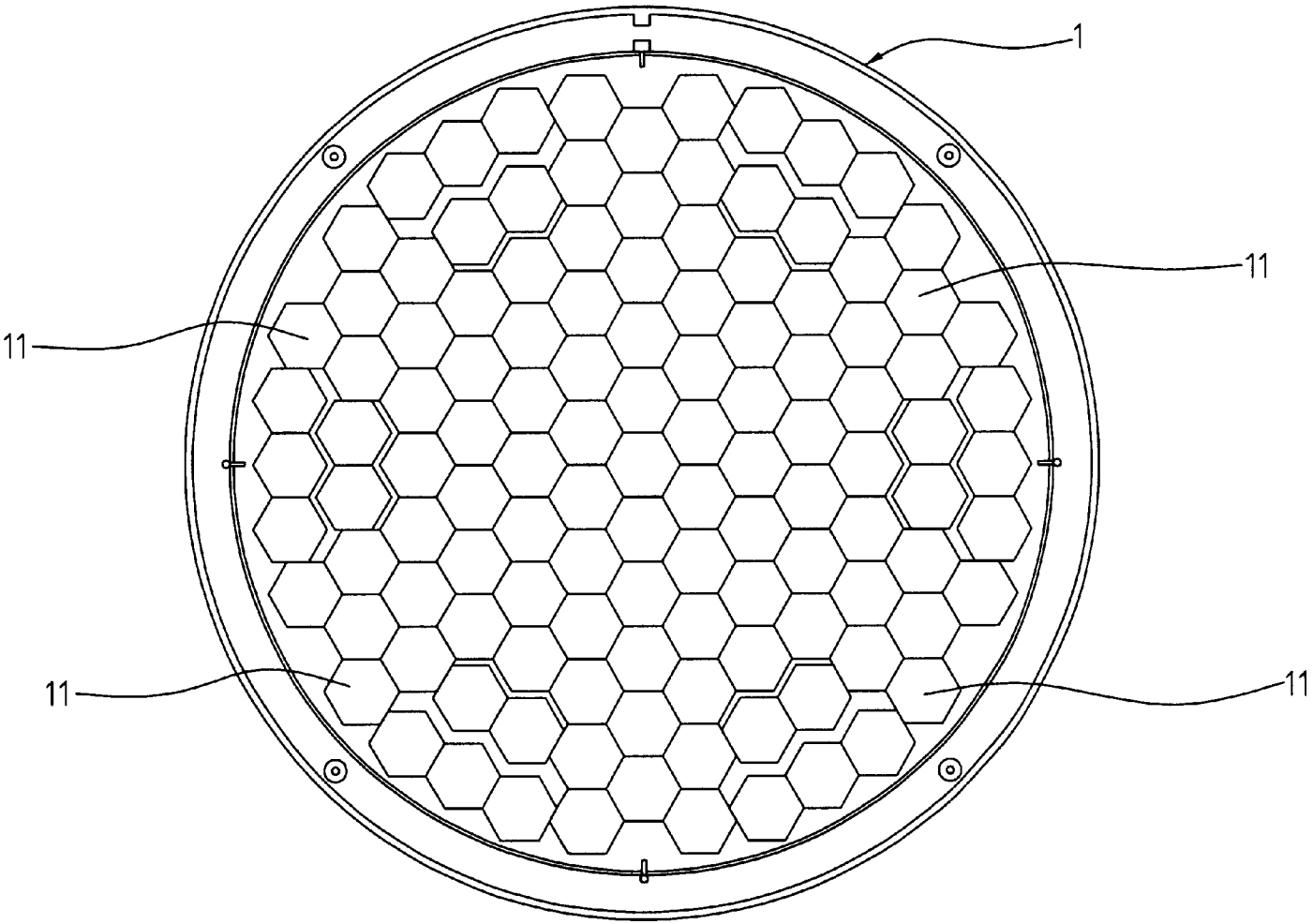
FIG. 5 indicates an incident surface of a front mantle of this invention.
Figure 5B:
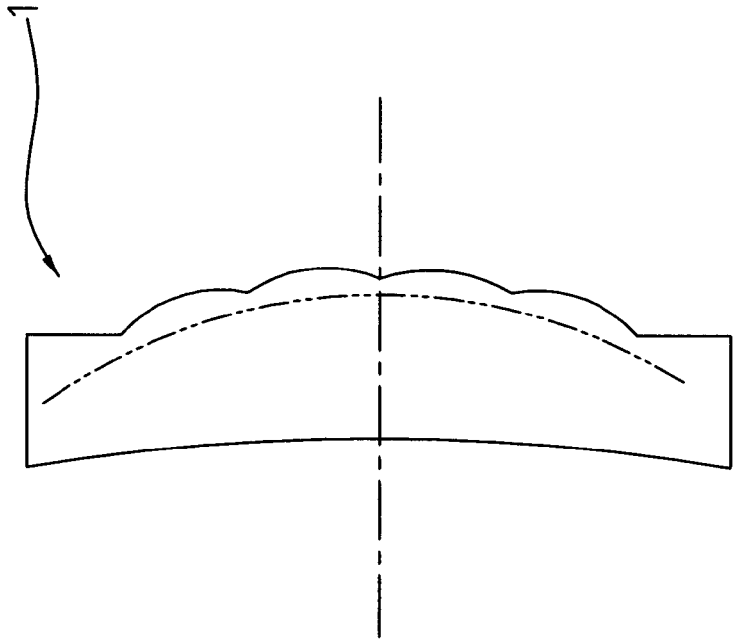
Figure 5A:
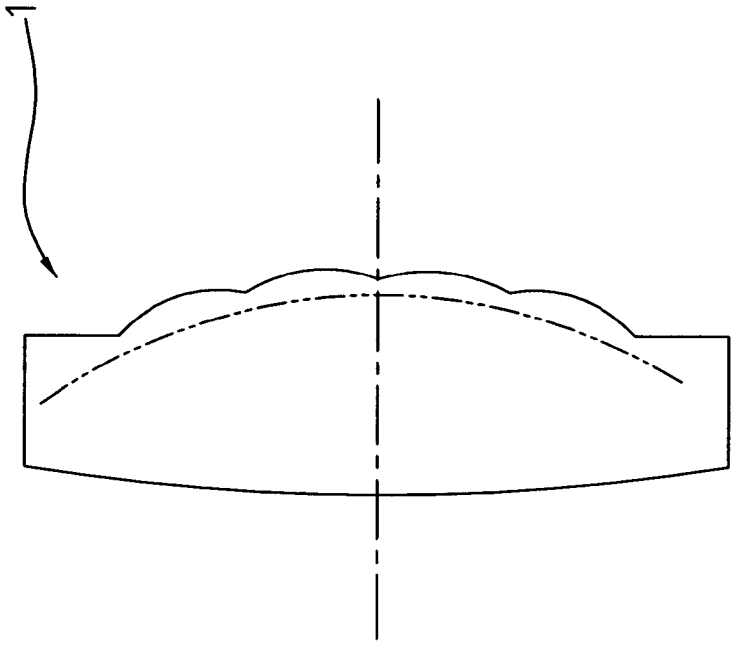
Figure 12:
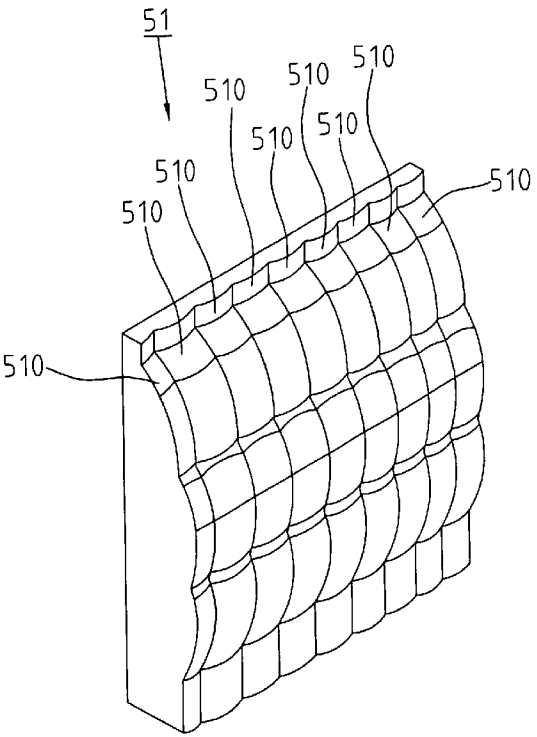
FIG. 12 is a perspective view of an embodiment 4 of the lens cell of this invention.
Figure 11:
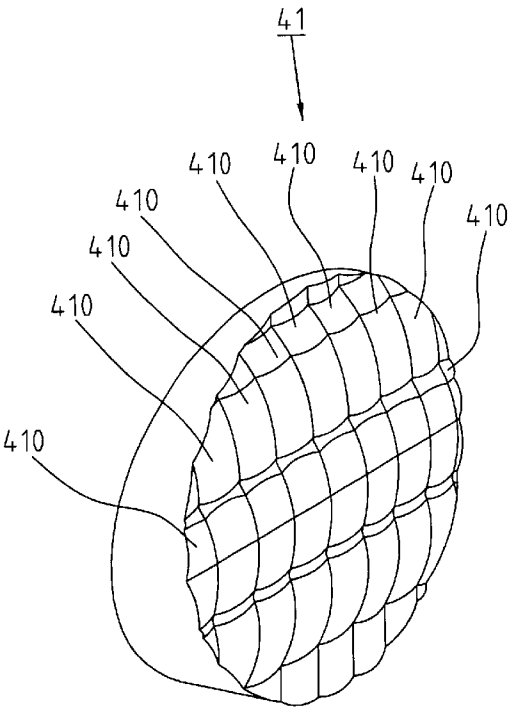
FIG. 11 is a perspective view of an embodiment 3 of the lens cell of this invention.

Embodiments 3 and 4 of this invention are shown in FIGS. 11 and 12 respectively, wherein a lens cell 41, 51 having its front appearance shaped as a circle or a rectangle is capable of optical modulation like the lens cell (11). In FIG. 1, the lens cell 41 has a plurality of lens humps 410 and some of them arc properly shaped so as to make the lens cell 41 circular. In FIG. 12, the humps 510 are arranged in such a way that the shape of the lens cell 51 becomes a rectangle.

Figure 13A:
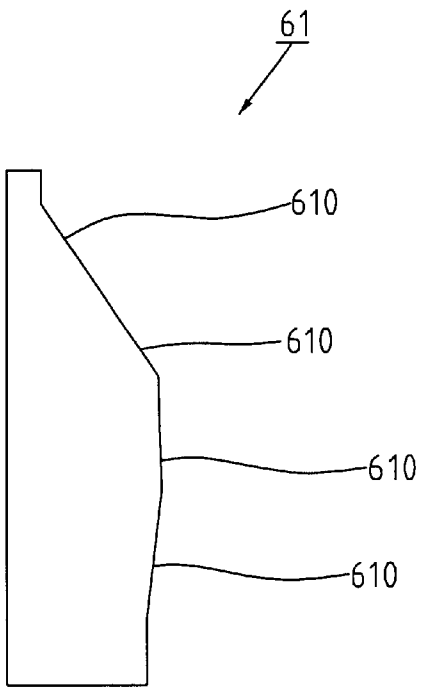
FIG. 13A is a cutaway sectional view o f the embodiment 5 of the lens cell of this invention.
Figure 13:
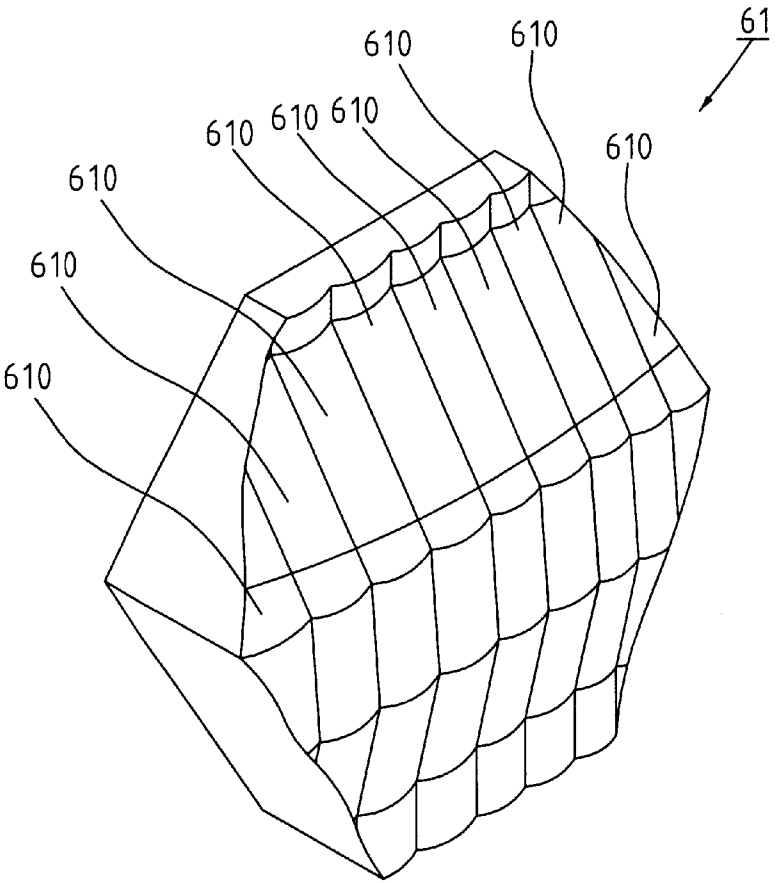
FIG. 13 is a perspective view of an embodiment 5 of the lens cell of this invention.

As illustrated in FIGS. 13 and 13A, in embodiment 5 of this invention, the curvature in vertical direction of a lens hump (610) on a lens cell (61) could be enlarged to infinity to result in a flush line, wherein the lens hump (610) of the lens cell (61) will redistribute the vertical light by taking advantage of refraction.

Figure 14A:
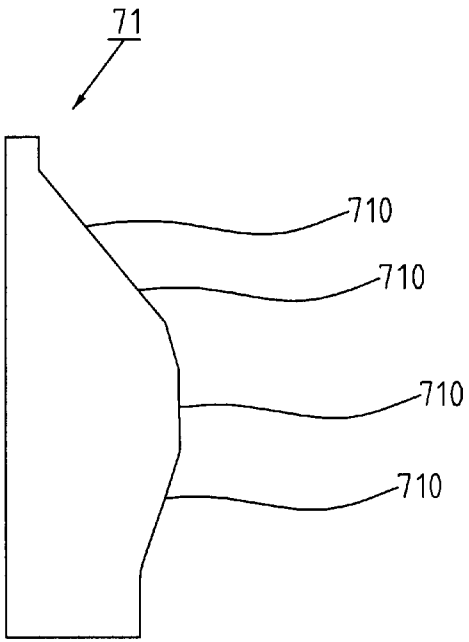
FIG. 14A is a cutaway sectional view of the embodiment 6 of the lens cell of this invention.
Figure 14:
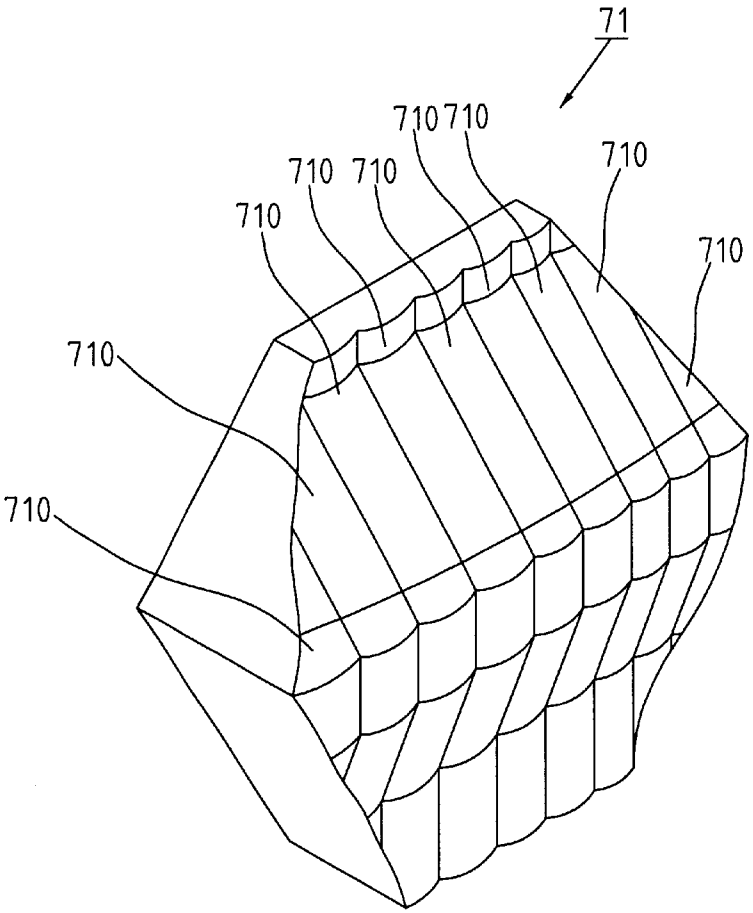
FIG. 14 is a perspective view of an embodiment 6 of the lens cell of this invention.

In embodiment 6 of this invention shown in FIGS. 14 and 14A, a plurality of continuous vertical and horizontal lens humps (710) on a lens cell (71) is curved in a negative curvature (a concave curve) to redistribute the vertical light by way of divergence.

Figure 15A:
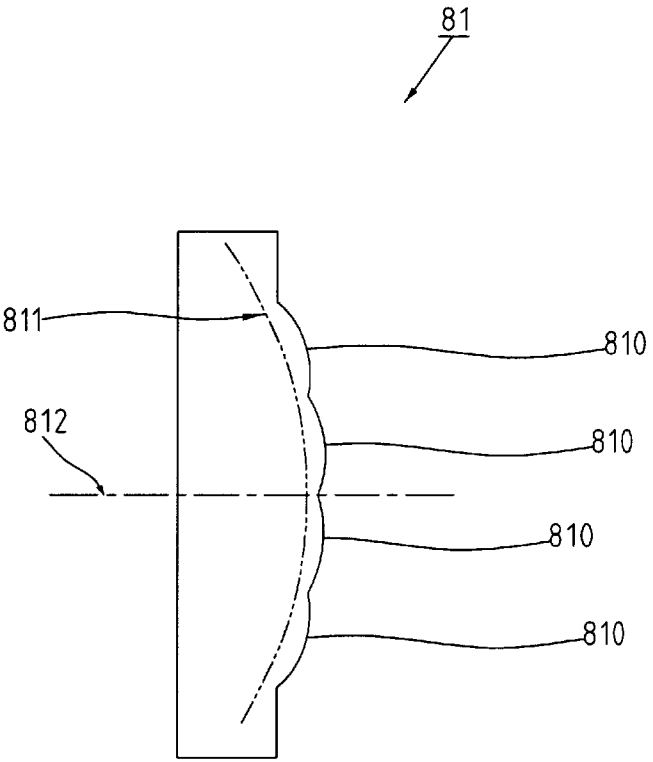
FIG. 15A is a cutaway sectional view of the embodiment 7 of the lens cell of this invention.
Figure 15:
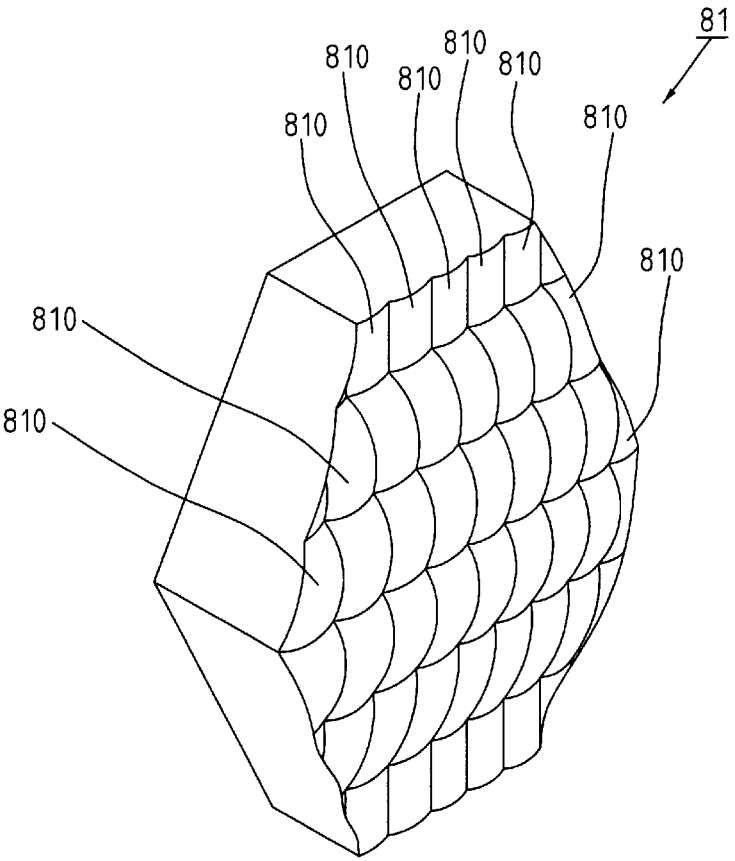
FIG. 15 is a perspective view of an embodiment 7 of the lens cell of this invention.

In embodiment 7 of this invention shown in FIGS. 15 and 15A, a plurality of lens humps (810) on a lens cell (81) is symmetrically distributed up and down. According to the cutaway section shown in FIG. 15A, the surfaces of lens humps (810) are constructed substantially in form of an arcuate curve (811) in lateral view, wherein an opening centerline (812) of the arcuate curve (811) is horizontally oriented; the curvature of the lens hump (810) in horizontal and vertical direction are equal to each other. By arrangement of the lens humps (810) in this manner, light is modulated, focused, and redistributed to enable this invention to be applicable for farther-distance usage that usually necessitates light cast over horizontal level, such as a highway signal light.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. An LED (light emitting diode) signal light, comprising:

a plurality of LEDs mounted on a circuit board; and a plurality of lens cells, each lens cell corresponding to an LED and having an external surface and an internal surface formed by a plurality of lens humps, said plurality of lens cells forming a front mantle for said signal light;

wherein each lens cell is located oppositely against a corresponding LED for modulating light emanated from the corresponding LED and redistributing the light both horizontally and vertically.

2. The LED signal light as claimed in claim 1, wherein said front mantle has a smooth plain external surface.

3. The LED signal light as claimed in claim 1, wherein said front mantle has a smooth external surface which is convex or concave.

4. The LED signal light as claimed in claim 1, wherein said plurality of lens cells are arrayed in an intensive, a staggered, or a blended manner to match with the shape of said front mantle.

5. The LED signal light as claimed in claim 1, wherein each lens cell is shaped in a polygon or an approximate circic.

6. The LED signal light as claimed in claim 1, wherein the internal surface of a lens cell forms a substantially bilaterally symmetrical curve in a horizontal cross section for modulating and redistributing light into multiple directions horizontally.

7. The LED signal light according to claim 1, wherein the internal surface of a lens cell forms a substantially arcuate curve in a vertical cross section, said arcuate curve having an opening oriented horizontally or obliquely slightly below a horizontal level.

8. The LED signal light according to claim 1, wherein the internal surface of a lens cell forms a substantially straight line in a horizontal cross section.

9. The LED signal light according to claim 1, wherein the internal surface of a lens cell forms a substantially arcuate curve in a vertical direction and a substantially arcuate curve in a horizontal direction with substantially identical curvatures.

10. The LED signal light according to claim 1, wherein each lens hump of a lens cell has identical curvatures in vertical and horizontal directions.

11. The LED signal light according to claim 1, wherein the lens humps of a lens cell have gradually increased or decreased curvatures in a horizontally outward direction.

12. The LED signal light according to claim 1, wherein the lens humps of a lens cell have gradually increased or decreased curvatures in a vertically outward direction.

13. The LED signal light according to claim 1, wherein a lens cell has an upper segment and a lower segment and the lens humps on said upper segment have different width as compared to the lens humps on said lower segment.

14. The LED signal light according to claim 1, wherein a lens hump of a lens cell has a concave surface.

* * * * *